US009138630B2

(12) United States Patent
Brandl

(10) Patent No.: US 9,138,630 B2
(45) Date of Patent: Sep. 22, 2015

(54) HEEL RETAINER WITH AUXILIARY LEVER

(71) Applicant: MARKER Deutschland GmbH, Penzberg (DE)

(72) Inventor: Christian Brandl, Garmisch-Partenkirchen (DE)

(73) Assignee: MARKER Deutschland GmbH, Penzberg (DE)

( * ) Notice: Subject to any disclaimer, the term of this patent is extended or adjusted under 35 U.S.C. 154(b) by 0 days.

(21) Appl. No.: 14/170,703

(22) Filed: Feb. 3, 2014

(65) Prior Publication Data

US 2014/0217703 A1 Aug. 7, 2014

(30) Foreign Application Priority Data

Feb. 1, 2013 (DE) ..... 10 2013 201 725

(51) Int. Cl.

| | |
|---|---|
| ***A63C 9/00*** | (2012.01) |
| ***A63C 9/08*** | (2012.01) |
| ***A63C 9/084*** | (2012.01) |
| *A63C 7/10* | (2006.01) |

(52) U.S. Cl.

CPC . *A63C 9/00* (2013.01); *A63C 9/001* (2013.01); *A63C 9/0807* (2013.01); *A63C 9/0844* (2013.01); *A63C 9/0845* (2013.01); *A63C 7/102* (2013.01)

(58) Field of Classification Search

CPC .... A63C 7/1046; A63C 7/102; A63C 9/0805; A63C 9/0807; A63C 9/0845; A63C 9/0846; A63C 9/005; A63C 9/001

USPC ..... 280/605, 611, 614, 623, 624, 626, 634, 280/636

See application file for complete search history.

(56) References Cited

U.S. PATENT DOCUMENTS

| | | | | |
|---|---|---|---|---|
| 3,731,943 | A * | 5/1973 | Wilkes | 280/613 |
| 3,830,510 | A * | 8/1974 | Stauffer | 280/654 |
| 4,500,108 | A * | 2/1985 | Johnson, III | 280/614 |
| 4,635,955 | A * | 1/1987 | Zoor | 280/614 |
| 4,900,052 | A | 2/1990 | Provence et al. | |
| 5,209,516 | A * | 5/1993 | Arduin et al. | 280/633 |
| 6,073,955 | A * | 6/2000 | Chonier | 280/605 |
| 7,431,310 | B2 * | 10/2008 | Redor et al. | 280/11.14 |
| 2003/0001363 | A1 | 1/2003 | Battistella et al. | |
| 2008/0309053 | A1 * | 12/2008 | Mangold et al. | 280/614 |
| 2011/0018232 | A1 | 1/2011 | Prigge et al. | |

OTHER PUBLICATIONS

USPTO Non-Final Office Action issued in U.S. Appl. No. 14/753,170 dated Jul. 28, 2015.

* cited by examiner

*Primary Examiner* — Frank Vanaman
(74) *Attorney, Agent, or Firm* — RatnerPrestia

(57) ABSTRACT

A heel retainer for a combined downhill and touring binding for a ski, including: a base plate which can be fastened on an upper side of the ski; a connecting structure; a tensioning device for securely holding a ski boot in the heel retainer, including a sole retainer; a shifting mechanism using which the heel retainer can be moved from a travelling position to a walking position and vice versa; and a latching mechanism which latches at least parts of the heel retainer in the travelling position or in the walking position. The latching mechanism includes a latching lever which can be operated manually or using a ski pole and which latches the heel retainer at least in the travelling position, wherein the parts of the heel retainer for changing from the travelling position to the walking position and vice versa can be linearly shifted on the base plate.

5 Claims, 10 Drawing Sheets

HEEL RETAINER WITH AUXILIARY LEVER

CROSS REFERENCE TO RELATED APPLICATIONS

This application claims priority to German Patent Application No. 10 2013 201 725.1, filed Feb. 1, 2013, the contents of such application being incorporated by reference herein.

FIELD OF THE INVENTION

The invention relates to a heel retainer for a combined downhill and touring binding for a ski. The heel retainer comprises: a base plate which can be connected to an upper side of the ski; a connecting structure; a tensioning device for securely holding a ski boot in the heel retainer, comprising at least one sole retainer; a latching mechanism which optionally latches at least one part of the heel retainer in a downhill position or in a touring position; and a shifting mechanism using which the heel retainer can be moved from a travelling position to a walking position. The heel retainer can also comprise a pressing body which biases at least parts of the heel retainer into the downhill position. The invention also relates to a ski comprising a ski binding which comprises a heel retainer in accordance with the invention.

SUMMARY OF THE INVENTION

An aspect of the invention to provide a heel retainer for a combined downhill and touring binding, which enables the binding to be adjusted on the ski from the downhill position to the touring position in a simple, quick and reliable way. Another object is that of providing a ski comprising the downhill and touring binding.

An aspect of the invention relates to a heel retainer for a combined downhill and touring binding for a ski, comprising: a base plate which can be fastened on an upper side of the ski; a connecting structure; and a tensioning device for securely holding a ski boot in the heel retainer, comprising a sole retainer.

The binding also comprises: a latching mechanism which optionally latches at least parts of the heel retainer in a downhill position or in a touring position; and a shifting mechanism using which parts of the heel retainer can be automatically or manually moved from the travelling position to the walking position.

In the following, the parts of the heel retainer which can be moved from a downhill position or travelling position to a touring position or walking position are also referred to as the heel retainer for short, in order to make the application easier to read. It will however be clear that the heel retainer as a whole can comprise more parts, for example the base plate, which are not among the parts of the heel retainer in Claim 1 which can be moved by the shifting mechanism.

The base plate is a base structure which is or can be fixedly connected to the ski, for example integrated into the surface of the ski. The base structure can consist of one piece and serve to connect a toe retainer and the heel retainer to the ski. The base structure can alternatively comprise at least two parts, one of which connects the toe retainer to the ski and another of which connects the heel retainer to the ski.

In accordance with an aspect of the invention, the latching mechanism comprises a latching lever which optionally latches the connecting structure in the travelling position or in the walking position.

The tensioning device is a known tensioning device which comprises at least one sole retainer and tensions the heel retainer into a holding position in which the ski boot is securely connected to the ski. The tensioning device can be relaxed, such that the heel retainer releases the ski boot, in order to step into and out of the ski.

The parts of the heel retainer which the latching mechanism optionally latches in the downhill position or in the touring position can for example be inter alia the connecting structure and the tensioning device.

In a first embodiment which is described in the following, the shifting mechanism can comprise a spring element which is supported on a strut on the pressing body and on an inner wall of the connecting structure. When the heel retainer is in the downhill position, the spring element is tensioned. In this position, the heel retainer can then be latched using the latching lever. When the latch is released, the spring element can be relaxed and thus automatically moves the heel retainer counter to the skiing direction, away from a toe retainer of the binding, into the walking position in which the heel retainer is again latched by the latching mechanism.

The latching mechanism of the first embodiment of the invention comprises a latching lever which optionally latches the heel retainer in the downhill position or in the touring position. The latching lever can be connected to the connecting structure in a pivoting joint which comprises a pivoting axle which extends parallel and transverse to the surface of the ski. The latching lever can be formed in one piece or can consist of two or more separate partial levers. The latching lever can consist of a plastic, a reinforced plastic or a metal or can comprise one or more of these materials.

In order to latch the heel retainer, the pressing body can comprise an engaging element, for example a toothing, and the latching lever can comprise a complementary engaging element, for example a complementary toothing, preferably at an end region which is a front end region in the skiing direction, in the first embodiment of the invention. In order to latch the heel retainer, the complementary engaging element on the latching lever engages with the engaging element on the pressing body. Aside from a toothed engagement, the latch can also for example be formed by a peg which can engage with various cavities or by other latches which are known to the person skilled in the art and suitable for this purpose.

The engaging element and/or for example toothing can be moulded directly onto the pressing body, i.e. the engaging element can be formed in one piece with the pressing body, for example in an injection-moulding method, by deforming a metal plate in a press, by a sintering method, or by other suitable shaping methods known to the person skilled in the art, depending on the material.

Alternatively, the engaging element can be fixedly connected to the pressing body, for example adhered, soldered, welded, screwed or riveted, or connected in a positive fit and/or force fit via other means or purely by shaping.

The engaging element exhibits at least two engaging positions: a first engaging position in which the complementary engaging element on the latching lever engages in order to latch the heel retainer and/or the parts of the heel retainer in the travelling position; and a second engaging position in which the complementary engaging element on the latching lever engages in order to latch the heel retainer and/or the parts of the heel retainer in the walking position.

The latching lever can be biased in an engaging direction together with the engaging and/or latching element on the pressing body by a spring element which is supported on the latching lever and on a lower side of for example the connecting structure, i.e. the spring element and/or the spring force of the spring element presses the complementary engaging element into the engaging element or into a space in front of or behind the engaging element and so latches the complementary engaging element to the engaging element in the travelling position and in the walking position, such that the latch cannot be unintentionally released during travelling, walking or transporting. The spring element can be a spiral spring, a leaf spring or an elastic solid body.

The spring element is preferably supported on the end of the latching lever which adjoins the region comprising the complementary latching element, at the front in the skiing direction. To this end, the latching lever can comprise a guide for the spring element, such that the spring element cannot slip away from the latching lever. The other end of the latching lever can comprise an engaging recess with which the tip of a ski pole can engage in order to press the latching lever onto the surface of the ski with the aid of the ski pole, thus compressing the spring element and therefore releasing the complementary latching element from its latch with the latching element.

The pressing body is connected to the base plate such that the pressing body comprising the latching element cannot be moved relative to the base plate during travelling, walking or transporting. The pressing body and the latching mechanism can be arranged between the base plate and the connecting structure.

In order that the heel retainer can be moved into the downhill position and into the touring position in a controlled and repeatable way, the pressing body can be pressed against an abutment, such that the heel retainer cannot be moved in the skiing direction beyond the downhill position. This abutment can for example be formed by the rear side of the pressing body.

In order to press the pressing body against the abutment, the heel retainer can comprise a holding element which is for example cylindrical and which comprises an outer thread which is attached and/or moulded on, wherein the outer thread can engage with grooves formed in the base plate. The outer thread and/or hollow cylinder can be screwed into an engagement with the grooves, as it were, into a desired position. A spring element, which is supported on an end of the holding element which is a front end in the skiing direction and on an inner wall of the pressing body, then presses the connecting structure against the end of the pressing body which is the rear end in the skiing direction.

The spring element additionally presses the holding element counter to the skiing direction, such that the flanks of the thread are pressed against the flanks of the grooves, whereby a force fit prevents the holding element from being independently moved out of its set position, for example by the vibration of the ski during descent.

The spring element also simultaneously forms a pressing spring for the heel retainer, wherein the connecting structure can be shifted a few millimeters counter to the direction of travel of the ski, against the resistance of the pressing spring, when stepping into the heel retainer with the ski boot. It is also possible, when the ski is bent in the longitudinal direction, for example during a descent, for the distance between a toe retainer and the heel retainer, which is shortened by the bending, to be compensated for by means of the spring.

The latching lever can be connected to the connecting structure in a pivoting joint. It can form a first lever arm and a second lever arm, wherein the first lever arm extends from the pivoting joint to the spring element which biases the latching lever into the latching position, and the second lever arm extends from the pivoting joint to the engagement for the ski pole, wherein the second lever arm is preferably longer than the first lever arm, which causes the unlatching force acting on the spring element to be amplified. As already stated, the latching lever can be formed in one piece or can consist of a plurality of separate partial levers.

The latching lever can protrude backwards from the heel retainer, in order to be operated using the ski pole; less preferably, the latching lever can protrude laterally from the heel retainer and/or abut the heel retainer in such a way that it can be folded down. The latching lever which can preferably be folded down using the ski pole can be biased into the position in which it is folded onto the heel retainer by a spring element. The latching lever and/or the part of the first lever arm which protrudes from the connecting structure can be protected by a bracket in order to protect against excess soiling and damage, wherein the bracket can be connected to the second connecting structure part.

In a second embodiment, the latching mechanism can comprise a latching lever which is connected to a spindle plate or carbon plate. The spindle plate is connected to the heel retainer and can move the heel retainer from the travelling position to the walking position and latch it in the respective position by means of the latching lever.

The latching lever can be connected to the ski in front of the heel retainer and preferably also in front of a ski brake in the skiing direction. To this end, a fixture is assembled on the surface of the ski, in which the latching lever is mounted in a pivoting joint which is also referred to in the following as the lever pivoting joint in order to unambiguously identify it. The fixture can simultaneously form a guide for the spindle plate, in order to prevent the spindle plate from being able to flex upwards. The fixture and/or guide extends up to the base plate of the heel retainer and is connected to the base plate such that the two parts cannot be moved relative to each other on the surface of the ski either in or counter to the skiing direction.

The spindle plate is connected to the latching lever in another pivoting joint, the spindle plate pivoting joint, wherein the lever pivoting joint is not identical to the spindle plate pivoting joint but rather exhibits a finite distance from it. A sort of toggle lever is thus formed which in a front position and in a rear position can be pivoted beyond the dead center in which the axes of the lever pivoting joint and the spindle plate pivoting joint lie on a horizontal line, which causes the latching lever to latch in the respective over-center position.

If the latching lever is manually moved about the pivoting axle of the lever pivoting joint, the spindle plate is simultaneously moved in the spindle plate pivoting joint, which causes a linear movement of the spindle plate, i.e. when the latching lever is in its foremost position on the ski, the heel retainer is in the travelling position and is latched in this position. If the latching lever is then manually moved backwards in the lever pivoting joint, the spindle plate is simultaneously moved counter to the skiing direction and the heel retainer is thus shifted from its travelling position to the walking position and latched in the latter position.

An end of the spindle plate which is a front end in the skiing direction is connected to the latching lever in the spindle plate pivoting joint. The end of the spindle plate which is the rear end in the skiing direction is designed to be connected to the connecting structure. Between its front end and rear end, the spindle plate can comprise a receptacle for a ski brake securing means which lies in front of the ski brake when the heel retainer is in the travelling position, such that the ski brake can be activated in the event that the ski detaches from the ski boot. When the heel retainer is in the walking position, the ski brake securing means can hold the ski brake fixedly in a secured position on the ski.

The ski brake securing means can for example be a sort of bracket or hook which engages, at least in the walking position, with a structure for example on the brake pedal in order to secure the ski brake during touring. Alternatively, it can for example be a mushroom-shaped peg which protrudes upwards from the upper side of the ski or from a part of the binding, for example the guiding plate, and—at least during touring—lies between the two spring brackets which bear the brake shoes, in a region in which the distance between the two spring brackets is equal to or greater than a diameter of the mushroom base but smaller than a diameter of the mushroom head. The spring brackets are then prevented by the mushroom head from pivoting from their resting position, substantially parallel next to the ski, to the braking position.

If the ski brake securing means is for example fixedly connected to the spindle plate, this can mean that a distance between the heel retainer and the ski brake is altered in the downhill position and the walking position, i.e. the ski brake is for example fixedly connected to the ski, and the heel retainer can be moved on the ski in and counter to the skiing direction via the spindle plate together with the ski brake securing means. Alternatively, the ski brake securing means can be fixedly connected to the ski, and the ski brake and the heel retainer can be moved together on the ski in and counter to the skiing direction, while the ski brake securing means is not moved. The never-changing distance between the ski brake and the heel retainer allows a design with fewer moving parts, which can have a favorable effect on the cost of the binding, and simultaneously prevents snow from clumping between the ski brake and the heel retainer, which can in particular be disadvantageous when adjusting the heel retainer from the walking position to the travelling position.

In order to be connected to the heel retainer, the spindle plate extends up to and/or into the base plate of the heel retainer and comprises a central rear region which can be designed to be connected to a holding element, wherein the holding element can be a cylindrical holding element comprising an outer thread which is attached or moulded on. The outer thread and/or the spirally extending bridges of the outer thread can engage with grooves formed in the central rear region of the spindle plate.

The holding element co-operates in a known way with a pressing body which comprises a spring element which presses the heel retainer into the travelling position and can be compressed in the longitudinal direction when stepping into the heel retainer or when the ski is bent, in order to vary the distance between a toe retainer and the heel retainer according to circumstances. The details regarding the holding element and the other functional parts of the heel retainer have already been described further above in connection with the first embodiment of the invention, hence with respect to the details, reference is made here to said embodiment.

The central rear region of the spindle plate can be a separate part which is or can be connected to the spindle plate. Alternatively, the central rear region can be formed in one piece with the spindle plate.

The central rear region of the spindle plate can protrude downwards from the spindle plate. This region can engage with an opening in the base plate. The end of the opening which is its front end in the skiing direction can form an abutment for the spindle plate and/or rear central region in the travelling position, and the end of the opening which is its rear end in the skiing direction can form an abutment for the spindle plate and/or rear central region in the walking position.

If the spindle plate comprises the central rear region described, then the spindle plate moves all the parts of the heel retainer or the heel retainer and a ski brake except for the base plate from the travelling position to the walking position.

In all the embodiments, the connecting structure can be formed from a plurality of connecting structure parts, wherein the first connecting structure part can be connected to the tensioning device in a pivoting joint, such that the tensioning device can be pivoted for stepping into and/or out of the heel retainer. The pivoting axle of the pivoting joint extends substantially parallel to the surface of the ski and transverse to the skiing direction.

A second connecting structure part can be linearly guided in the base plate parallel to the surface of the ski in and counter to the skiing direction and can be connected to the first connecting structure part in another pivoting joint, wherein the pivoting axle of this pivoting joint is substantially perpendicular to the surface of the ski. The first connecting structure part can be pivoted relative to the second connecting structure part in said other pivoting joint, thus ensuring that the heel retainer is transversely released when a corresponding force is applied.

The transverse release force can be set by means of a release device, wherein the release device comprises a spring-loaded roller which can be moved in a linkage transverse to the skiing direction. The linkage can be connected to the second connecting structure part or formed in one piece with the second connecting structure part. The shape of the linkage and the spring force of the spring element determine the magnitude of the lateral release force for transversely releasing the heel retainer.

The tensioning device comprises a sole retainer. The sole retainer can be formed from two separate partial sole retainers, wherein the partial sole retainers comprise a sole retainer element in the form of a roller which abuts directly onto the sole of the ski boot and rolls off on the sole of the ski boot when laterally released. This reduces a frictional force between the sole retainer and the sole of the ski boot, such that the theoretical release force of the release device substantially corresponds to the release force actually applied and is not additionally increased by a frictional force of unknown magnitude between the sole retainer and the sole of the ski boot.

In order to ensure a reliable release when a large transverse force occurs, a contact area for the ski boot is formed as a sliding plate. This sliding plate can be connected to the base plate or for example to the spindle plate or can be formed as a part of the ski brake, in particular as a pedal of a ski brake.

The sliding plate can comprise a surface or an insert made of a metal, plastic or other material which reduces a frictional resistance between the sliding plate and a lower side of the sole of the ski boot.

Alternatively or additionally, the sliding plate can be mounted on rollers, wherein the rollers exhibit a rotational axis which preferably extends substantially parallel to a longitudinal axis of the binding. The rollers can be rotationally mounted in roller bearings or on a fixed axle. The receptacles for the rollers can be formed in the contact area or in the pedal of the ski brake, respectively.

The heel retainer can comprise at least one climbing aid which can be pivoted from a secured position in the downhill position to a touring position, wherein the climbing aid can be held in the secured position by a spring element during descent and/or in the touring position.

The heel retainer preferably comprises at least two climbing aids, wherein the first climbing aid supports the ski boot at a first climbing angle, and the second climbing aid supports the ski boot at a second climbing angle which is different from the first climbing angle. The climbing aid or aids can be secured in the secured position during travel by a spring element each or by a common spring element. The same applies to securing the climbing aid in the folded-down walking position. Preferably, the two or more climbing aids can be pivoted into the walking position one after the other, starting with the climbing aid which exhibits the lowest climbing angle.

The invention also relates to a ski comprising a ski binding which comprises the heel retainer described above.

BRIEF DESCRIPTION OF THE DRAWINGS

In the following, an example embodiment of a heel retainer is explained on the basis of figures. All the features which are essential to the invention and shown in the figures form part of the scope of the invention and can advantageously develop the invention, individually and in the combinations shown.

Specifically, the figures show.

DETAILED DESCRIPTION OF THE INVENTION

Figure 1:
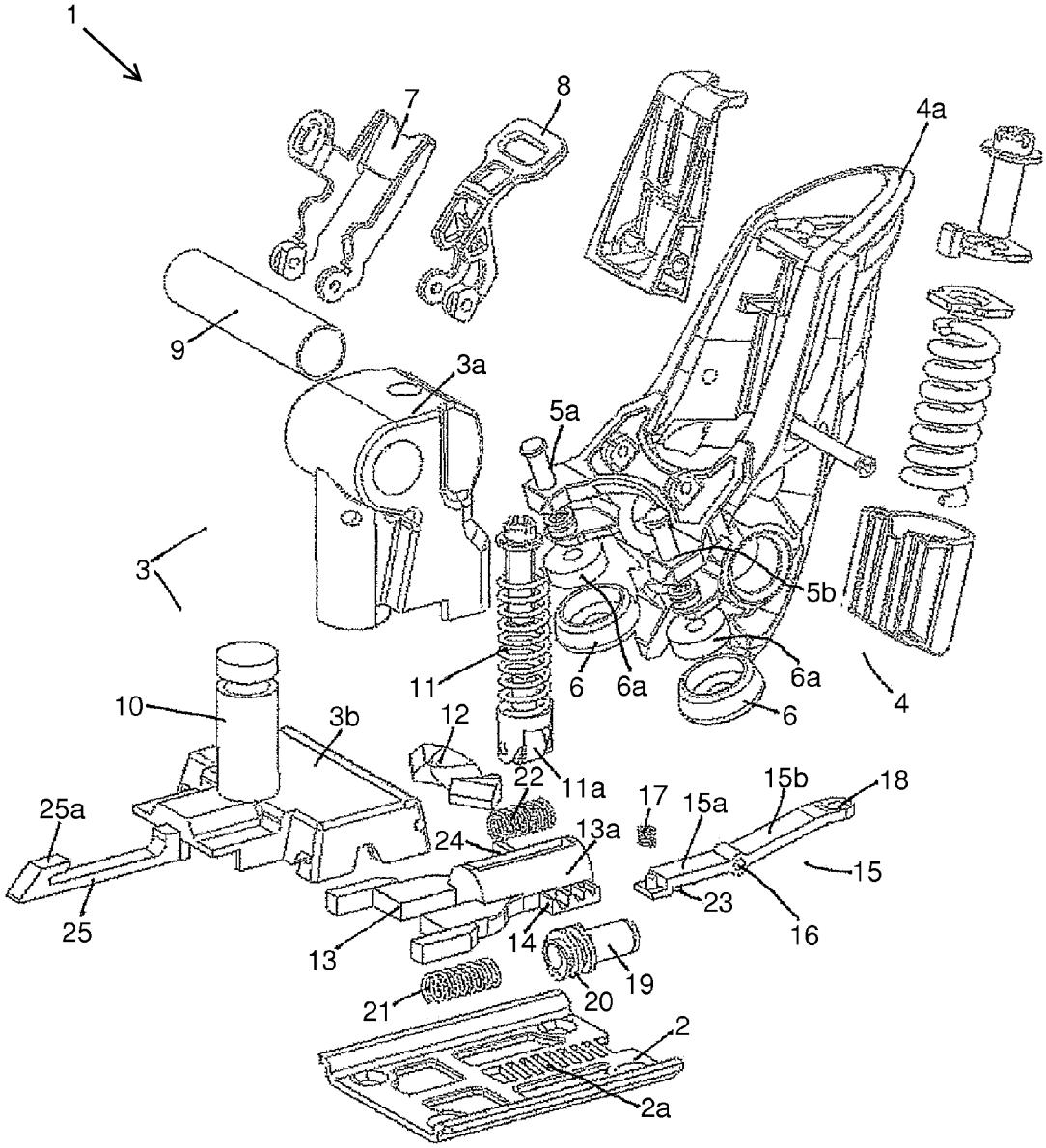
FIG. 1 an exploded drawing of a first embodiment of the heel retainer in accordance with the invention.

FIG. 1 shows an exploded drawing of a first example embodiment of a heel retainer 1 of a ski binding. The heel retainer 1 comprises a base plate 2 and a first connecting structure part 3*a* and a second connecting structure part 3*b* which together form a connecting structure 3, wherein the second connecting structure part 3*b* comprises a cylindrical pivoting axle 9 which protrudes vertically upwards and onto which the first connecting structure part 3*a* can be fitted, such that the first connecting structure part 3*a* can be pivoted relative to the second connecting structure part 3*b* about the pivoting axle 9, for example when the heel retainer is transversely released.

The connecting structure part 3*b* comprises an extension 25 in the skiing direction which comprises a hook-shaped front end 25*a*. The extension 25 forms a holding device for a ski brake (not shown) which secures the ski brake in the walking position against being released.

The heel retainer 1 also comprises a tensioning device 4 featuring a skeletal tensioning device body 4*a* which comprises a sole retainer 5 which consists of a first partial sole retainer 5*a* and a second partial sole retainer 5*b*. In the example embodiment, the two partial sole retainers 5*a*, 5*b* are identical in design and each comprise a roller 6 and a rotary bearing 6*a*, wherein the roller 6 directly abuts the sole of a ski boot and minimizes a frictional resistance between the sole of the ski boot and the sole retainer 5, for example when the heel retainer 1 is transversely released.

The tensioning device 4 is connected to the first connecting structure part 3*a* in a pivoting joint by means of a hollow-cylindrical pivoting axle 9, such that the tensioning device 4 can be pivoted about the pivoting axle 9 towards and away from the surface of a ski.

Two climbing aids 7, 8 can be held in a secured position by a spring element (not shown) when the heel retainer 1 is in the travelling position, and folded into a climbing position when the heel retainer 1 is in the walking position.

The first connecting structure part 3*a* also forms a housing for a release device 11 for transversely releasing the heel retainer 1, comprising a roller 11*a* which is guided in a linkage 12. The linkage 12, which is shown as a separate part in the exploded drawing, can be fixedly connected to the second connecting structure part 3*b* or formed in one piece with the second connecting structure part 3*b*.

A pressing body 13 which is arranged between the base plate 2 and the second connecting structure part 3*b* comprises a toothing 14 which in the example embodiment is moulded on.

A latching lever 15 comprises a complementary toothing 23 comprising teeth which can engage with the toothing 14 in order to optionally latch the heel retainer 1 in the travelling position or in the walking position. The latching lever 15 can be connected to the second connecting structure part 3*b* in a pivoting joint 16 and comprises a first lever arm 15*a* and a second lever arm 15*b*. The complementary toothing 23 and, in front of the complementary toothing 23 in the skiing direction, a cylindrical receptacle for a spring element 17 are formed on the first lever arm 15*a*. The spring element 17 can be supported on the latching lever 15 and on a lower side of the second connecting structure part 3*b* and press the complementary toothing 23 into the toothing 14. The end of the second lever arm 15*b* which points away from the pivoting joint 16 comprises an engaging recess 18 with which the skier can engage the tip of a ski pole in order to press the latching lever 15 onto the surface of the ski, thus compressing the spring element 17 and moving the complementary toothing 23 out of the toothing 14.

The pressing body 13 comprises a semi-cylindrical receptacle 13*a* for a holding element 19. The holding element 19 comprises a cylindrical holding element body, wherein an end of the holding element body which is a front end in the skiing direction comprises an outer thread 20 which can engage spirally with grooves or slits 2*a* of the base plate 2, such that the holding element 19 cannot independently be moved relative to the base plate 2 in or counter to the skiing direction.

A spring element 21 which is for example supported on an inner wall of the pressing body 13 and on the holding element 19 in an opening in the region of the outer thread 20 presses the heel retainer 1 into the travelling position and simultaneously presses the flanks of the outer thread 20 against the sides of the grooves or slits 2*a* and thus establishes an additional force fit between the pressing body 13 and the base plate 2.

Another spring element 22 is supported on a transverse strut 24, which is moulded on the receptacle 13*a* of the pressing body 13, and on an inner wall of the connecting structure part 3*b*. The spring element 22 is compressed when the heel retainer 1 is latched in the downhill position by the latching lever 15. If the latching lever 15 is then operated using the ski pole, such that the complementary toothing 23 disengages from the toothing 14, the spring element 22 or the release spring 22 moves the heel retainer 1 counter to the skiing direction relative to the base plate 2, i.e. the heel retainer 1 is linearly offset backwards on the ski, such that the sole retainer 5 no longer presses the sole of the ski boot against the ski and the heel of the ski boot can be lifted off the surface of the ski unimpeded, for a walking movement.

Figure 2:
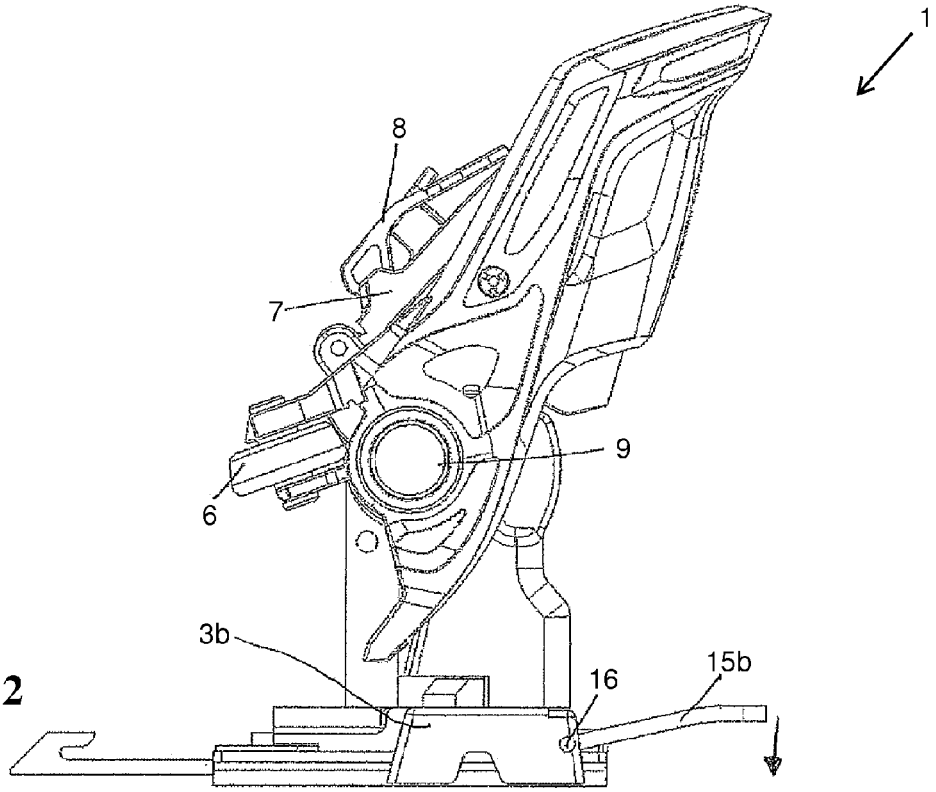
FIG. 2 a lateral view of the assembled heel retainer of FIG. 1.

FIG. 2 shows a lateral view of the assembled heel retainer 1 of FIG. 1. The latching lever 15 and/or the lever arm 15*b* protrude beyond the end of the heel retainer 1, such that the lever arm 15*b* is easily accessible to the tip of a ski pole and can be pressed onto the surface of the ski in the direction of the arrow by means of the tip of the ski pole. The latching lever 15 is connected to the connecting structure part 3*b* in a pivoting joint 16.

Figure 3:
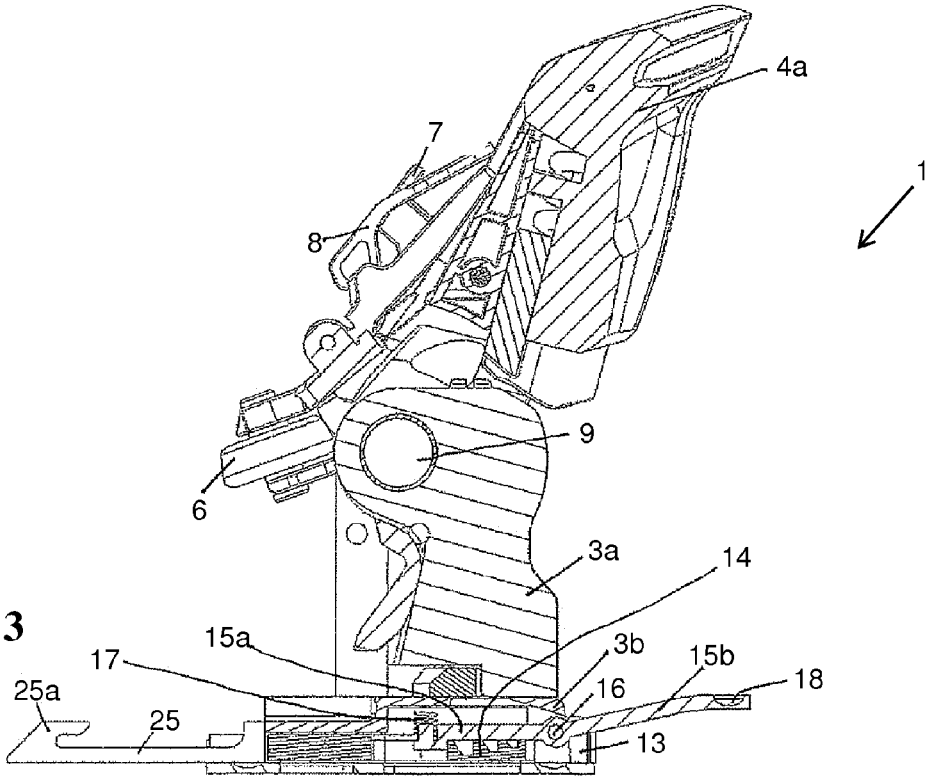
FIG. 3 a longitudinal section through the heel retainer of FIG. 1 in the travelling position, at the level of the latching lever.

FIG. 3 shows a longitudinal section through the heel retainer 1 in the travelling position. The connecting structure 3*a*, 3*b* is in its foremost position in which the ski can be used for travel or a descent. In this position, the sole retainer 5 presses the ski boot onto the ski. The latching lever 15 and/or complementary toothing 23 is in an engagement with the toothing 14 and thus latches the heel retainer 1 in the travelling position. The spring 17, which is supported on an inner wall of the connecting structure part 3*b* and on the lever arm 15*a* in a region in front of the toothing 14 in the skiing direction, presses the lever arm 15*a* and/or complementary toothing 23 into the toothing 14 and latches the lever 15 in this position. In the example embodiment, the pressing body 13 protrudes backwards out of the connecting structure part 3*b* when the heel retainer 1 is in the travelling position, and the lever 15 is arranged next to the pressing body 13.

Figure 4:
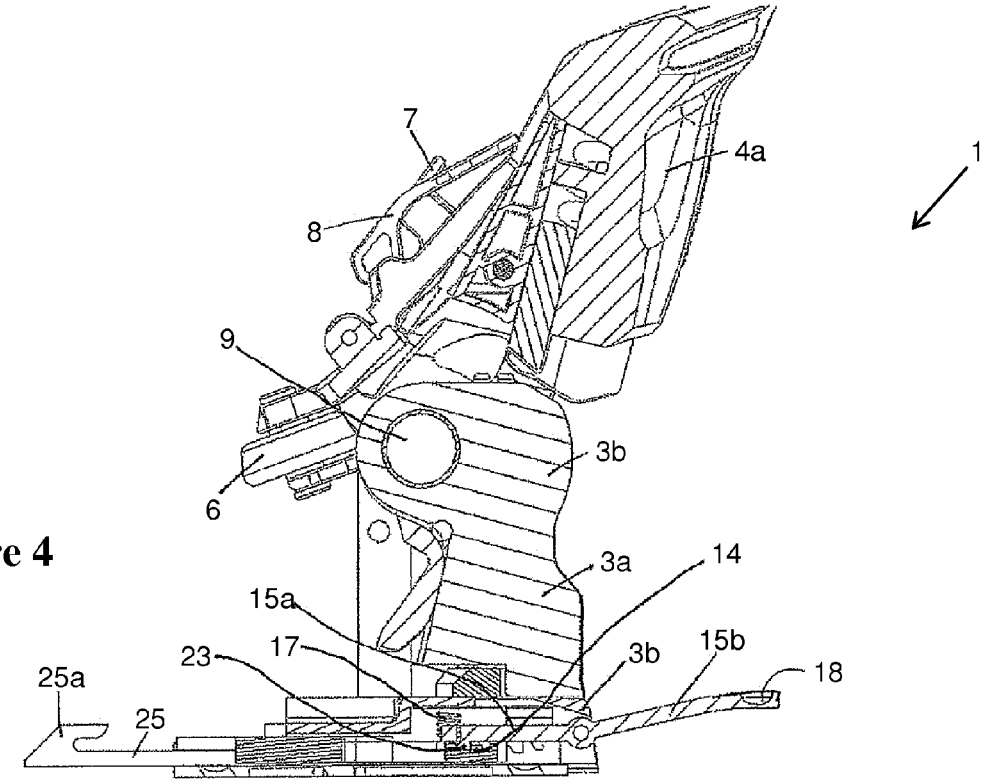
FIG. 4 a longitudinal section through the heel retainer of FIG. 1 in the walking position, at the level of the latching lever.

FIG. 4 shows the heel retainer 1 of FIG. 3 in the walking position. In order to pass from the travelling position to the walking position, the heel retainer 1 has been linearly shifted on the ski counter to the skiing direction. To this end, the skier has had to stick the tip of a ski pole into the engaging recess 18 on the lever arm 15*b* and press the lever arm 15*b* onto the surface of the ski. This releases the latch between the toothing 14 and the complementary toothing 23 shown in FIG. 3, and the heel retainer 1 and/or the connecting structure 3, the tensioning device 4 and the latching lever 15 can be moved backwards, counter to the direction of travel, on the ski by the spring element 22 (not shown, since it is behind the pressing body 13 in the drawing).

In FIG. 4, the heel retainer 1 is in the latched walking position in which the complementary toothing 23 on the lever arm 15*a* is again pressed by the spring element 17 into a space in front of the toothing 14 connected to the pressing body 13, in order to latch the heel retainer 1 in the walking position.

Figure 5:
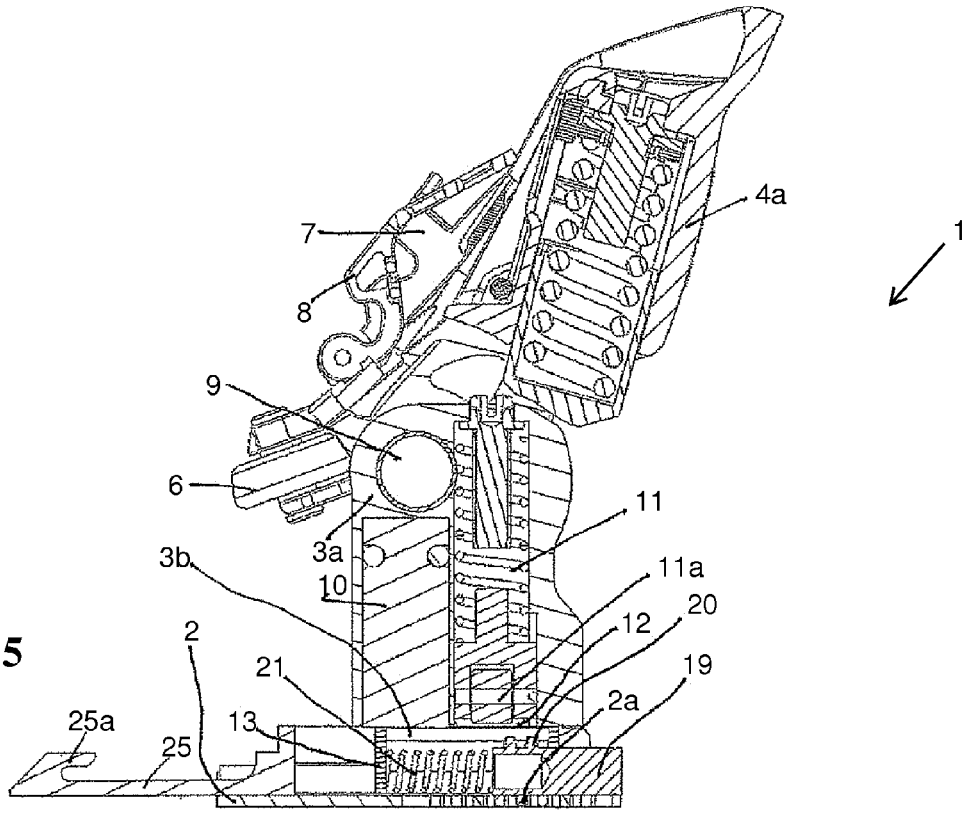
FIG. 5 a longitudinal section through the heel retainer of FIG. 1, at the level of the abutment.

FIG. 5 shows a central longitudinal section through the heel retainer 1 of FIG. 2. The holding element 19, comprising the outer thread 20 and the spring element 21 which is supported on the holding element 19 and on an inner wall of the pressing body 13, is shown. The outer thread 20 engages with grooves 2*a* in the base plate 2 and thus fixes the position of the holding element 19 relative to the base plate 2. The spring element 21 presses the flanks of the outer thread 20 against the walls of the grooves 2*a* which are the rear walls in the skiing direction and simultaneously presses the pressing body 13 into a front abutment position on the base plate 2 in which the heel retainer 1 can be latched in the travelling position.

FIG. 5 also shows: the pivoting axle 10, about which the connecting structure part 3*b* can be pivoted about the connecting structure part 3*a*; the release device 11 comprising the roller 11*a*; and the linkage 12.

Figure 6:
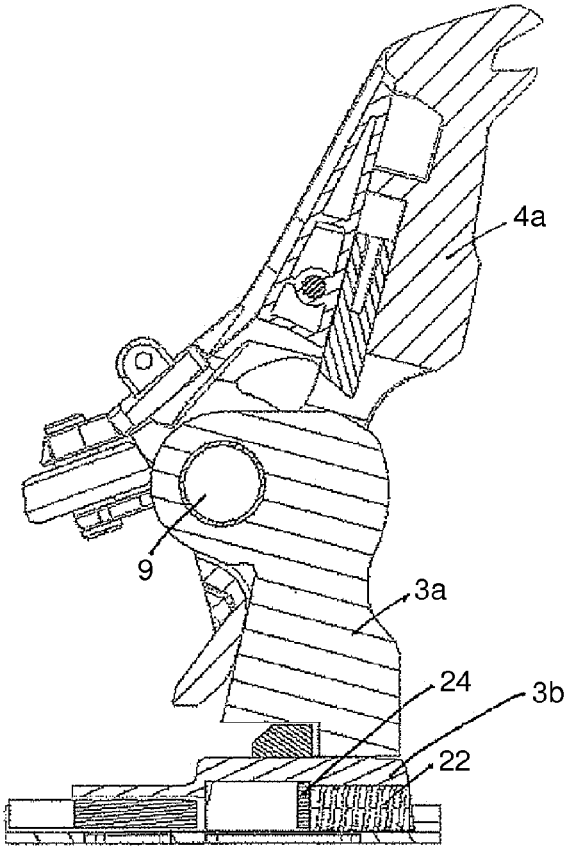
FIG. 6 a longitudinal section through the heel retainer of FIG. 1 in the travelling position, at the level of the release spring.
Figure 7:
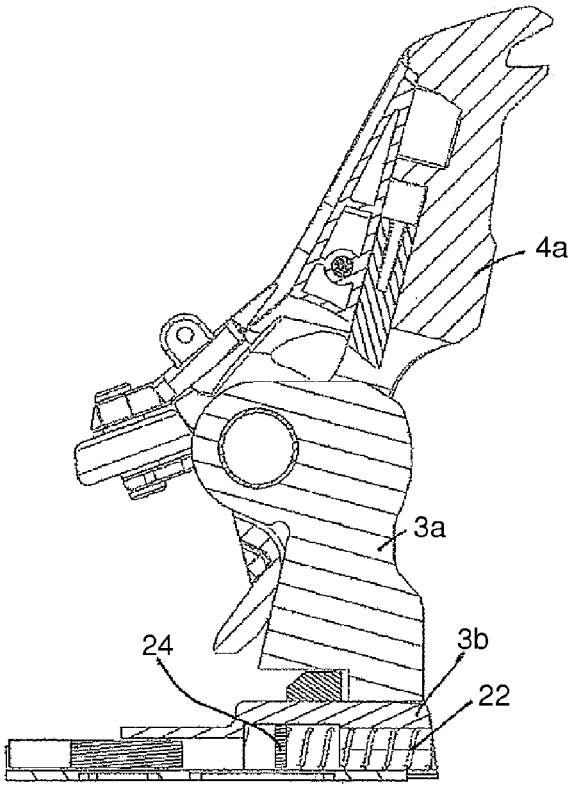
FIG. 7 a longitudinal section through the heel retainer of FIG. 1 in the walking position, at the level of the release spring.

FIGS. 6 and 7 each show a longitudinal section through the heel retainer 1 of FIG. 2, at the level of the release spring 22. One end of the release spring 22 is supported on the transverse strut 24 which is connected to the pressing body 13, and the other end is supported on an inner wall of the connecting structure part 3*b*. FIG. 6 shows the heel retainer 1 in the travelling position in which the release spring 22 is tensioned. FIG. 7 shows the heel retainer 1 in the walking position in which the release spring 22 has been relaxed and has thus moved the heel retainer 1 on the ski backwards into the walking position.

Figure 8:
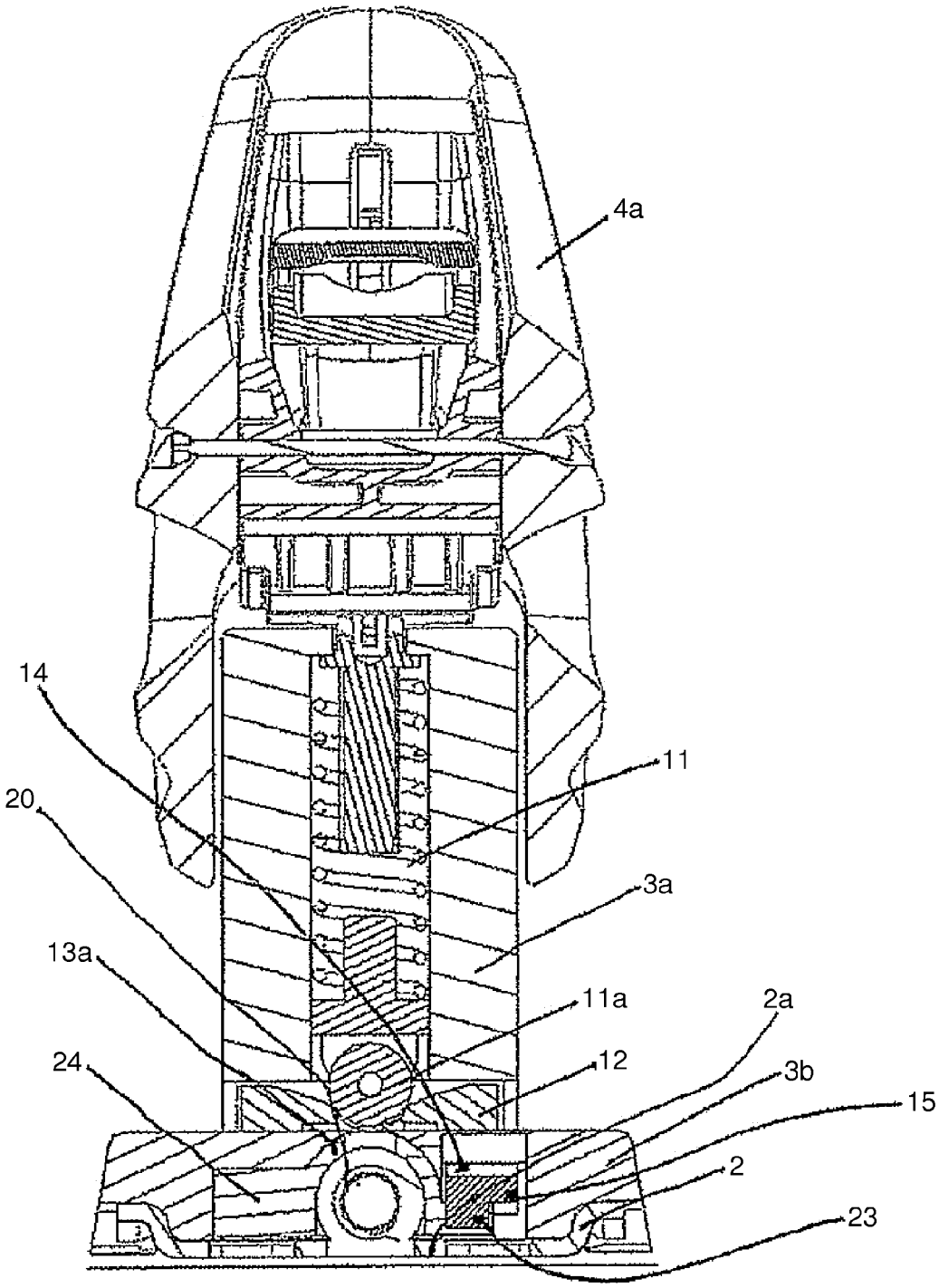
FIG. 8 a cross-section through the heel retainer of FIG. 1, at the level of the transverse release device.

FIG. 8 is a cross-section through the heel retainer 1 of FIG. 2, at the level of a central axis of the release device 11 for transversely releasing the heel retainer 1. FIG. 8 shows the tensioning device body 4*a* and the release device 11 comprising the roller 11*a*, which are both accommodated in the connecting structure part 3*a*, and the linkage 12 which is arranged on the surface of the connecting structure part 3*b*. The connecting structure part 3*b* is guided in the base plate 2, such that the connecting structure part 3*b* can be moved relative to the base plate 2 in and counter to the skiing direction.

The pressing body 13, comprising the toothing 14 which is moulded on and the transverse strut 24 on which the release spring 22 (not shown) is supported, is arranged on the base plate 2. The holding element 19 is arranged below the pressing body 13 and comprises an outer thread 20 which can engage with grooves 2*a* of the base plate 2. The lever 15 comprising the complementary toothing 23 is shown in an engagement with the toothing 14.

Figure 9:
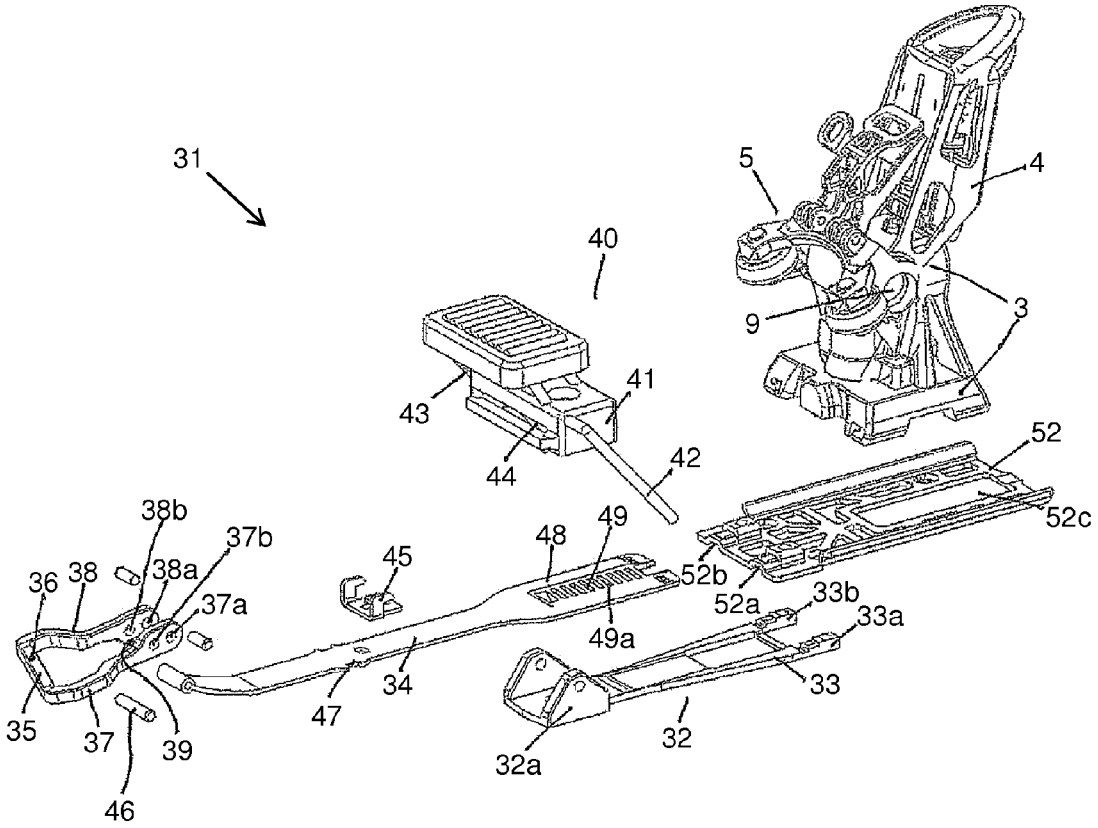
FIG. 9 an exploded drawing of a second embodiment of the heel retainer in accordance with the invention.

FIG. 9 shows a second example embodiment of a heel retainer 31 in accordance with the invention which, like the heel retainer 1 of the first example embodiment, is moved by a linear shift on the surface of the ski in and counter to the skiing direction from the travelling position to the walking position and vice versa.

The functionally most important parts of the heel retainer 31 are shown, namely: the connecting structure 3; the tensioning device 4 comprising the sole retainer 5 which is connected to the connecting structure 3 in a horizontal pivoting axle 9; the base plate 52; and the shifting mechanism.

The base plate 52 is designed to accommodate the connecting structure 3, such that the connecting structure 3 can be linearly moved on the base plate 52 in and counter to the skiing direction. The base plate 52 also comprises inter alia two engagements 52*a*, 52*b* and a cavity 52*c*, the relevance of which will be explained below.

The shifting mechanism comprises: a fastening device 32 comprising a guiding portion 33; a spindle plate 34; and a latching lever 35. The latching lever 35 comprises a grip 36, which can be manually grasped by the user, and two lateral arms 37, 38 which comprise two bores 37*a*, 37*b* and 38*a*, 38*b* each. The two arms 37, 38 are connected by a bridge 39 at the level of the bores 37*b*, 38*b*.

The end of the fastening device 32 which is the front end in the skiing direction comprises a mounting 32*a*, and the end of the guiding portion 33 which is the rear end in the skiing direction comprises two engaging elements 33*a*, 33*b* which can engage with the engagements 52*a*, 52*b* of the base plate 52, in order to connect the fastening device 32 to the base plate 52. The guiding portion 33 also comprises two lateral delineations which form a guide for the spindle plate 34, and bridges which connect the two delineations and form a bearing support for the spindle plate 34.

The bores 37*a*, 38*a* serve to connect the lever 35 to the fastening device 32 in a lever pivoting joint. The bores 37*b*, 38*b* serve to connect the lever 35 to the spindle plate 34 in a spindle plate pivoting joint. The bridge 39 forms an abutment for the spindle plate 34 when the heel retainer 31 is in the travelling position.

The spindle plate 34 comprises an end which is a front end in the skiing direction and which is designed to be connected to the lever 35 by an axial body 46 in the bores 37*b*, 38*b*. It also comprises an accommodating region 47 which is designed to be connected to a latching element 45 for a ski brake 40, and an end region 48 comprising a connecting region 49, featuring grooves 49*a* in the cavity 52*c*, for connecting the spindle plate 34 to the base plate 52 and to the connecting structure 3 by means of a holding element 19 (not shown).

FIG. 9 also shows the ski brake 40 which comprises a base body 41, which can be fixedly connected to the ski, and two pedal-operated brake elements 42, 43. The ski brake 40 also comprises an opening 44 through which the spindle plate 34 is guided. Also shown is the latching element 45 which can be connected to the spindle plate 34 such that it participates in all the movements of the spindle plate 34.

Figure 10:
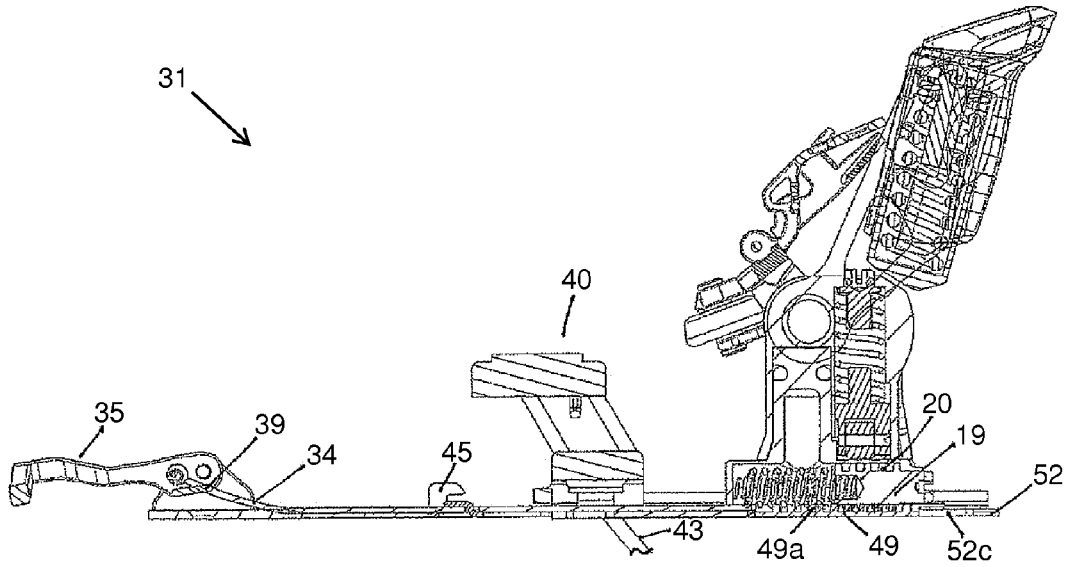
FIG. 10 a longitudinal section through the heel retainer of FIG. 9 in the travelling position.

FIG. 10 shows the heel retainer 31 of FIG. 9 in a sectional drawing, in the travelling position. The lever 35 is in its foremost position in the skiing direction, in a so-called over-center position in which the lever 35 latches the heel retainer 31 in the travelling position. In this position, the bridge 39 can additionally press against the spindle plate 34, thus drawing the heel retainer 31 and/or spindle plate 34 into the travelling position with an additional force. The ski brake 40 is not latched, and the latching element 45 is in a position in which the skier can move the ski brake 40 and/or the brake elements 42, 43 into the secured position next to the ski by applying a load to the pedal, and from which the ski brake 40 is automatically released when the load on the pedal is relaxed.

FIG. 10 also shows the holding element 19 comprising the outer thread 20, wherein the bridges of the outer thread 20 engage with the grooves 49*a* of the connecting region 49 of the spindle plate 34 and thus enable the heel retainer 31 to be linearly shifted in the cavity 52*c* of the base plate 52.

In order to move the heel retainer 31 from the travelling position shown in FIG. 10 to the walking position, the user has to grasp the grip 36 on the lever 35 and pivot the lever 35 in the lever pivoting joint by about 180 degrees. Simultaneously, the user has to press the ski brake 40 into the travelling position, in order that the latching element 45 can latch the ski brake 40 for the travelling position.

Figure 11:
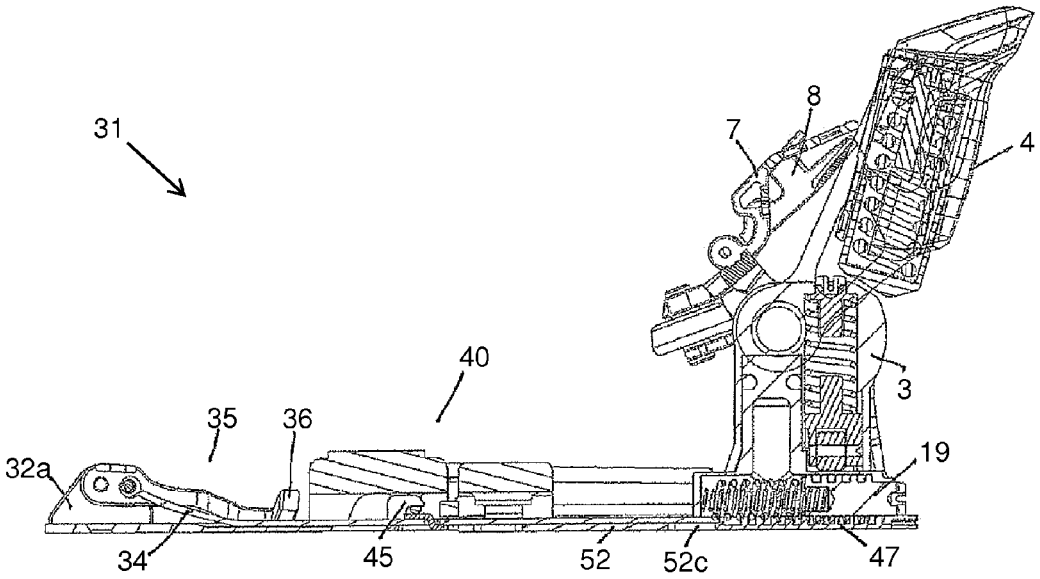
FIG. 11 a longitudinal section through the heel retainer of FIG. 9 in the walking position.

FIG. 11 shows the heel retainer 31 in the walking position. The grip 36 of the lever 35 now points towards the end of the ski, and the ski brake 40 is fixed in the walking position by the latching element 45. The end of the spindle plate 34 and/or accommodating region 47 which is the rear end in the skiing direction abuts the edge of the cavity 52*c* of the base plate 52 which is the rear edge in the skiing direction. At least one of the climbing aids 7, 8 can then be folded down from the tensioning device 4 for walking.

Figure 12:
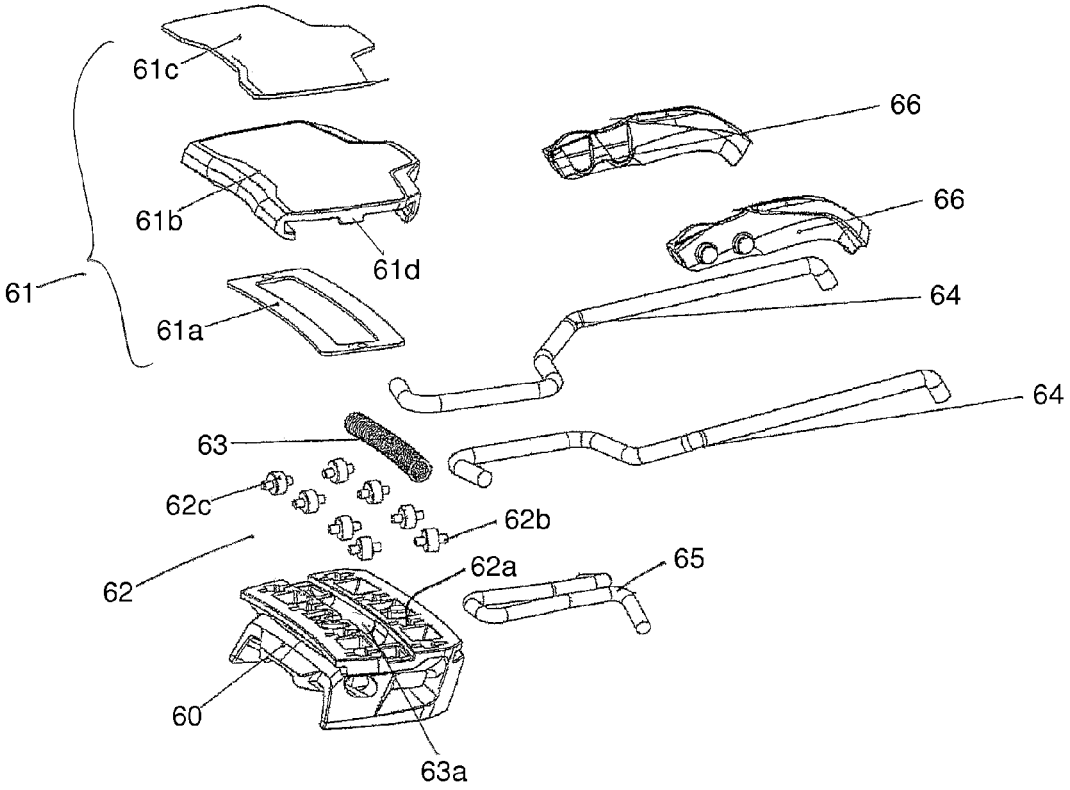
FIG. 12 an exploded drawing of a ski brake comprising a sliding plate, mounted on rollers, on the pedal.

FIG. 12 shows an exploded drawing of an example embodiment of a ski brake comprising a pedal 60 which can be connected to a sliding plate 61. The sliding plate 61 consists of a sliding piece support 61*a*, a sliding piece 61*b* and a sliding piece insert 61*c*. The sliding piece 61*b* can be formed from plastic, for example in a plastic injection-moulding method. The sliding piece insert 61*c* consists of a material comprising a smooth surface which exhibits a low frictional resistance, such as for example Teflon.

The pedal 60 comprises receptacles 62*a* into which rollers 62 can be inserted. In the example embodiment, the rollers 62 are axial rollers comprising an axle 62*b* on which the roller bodies 62*c* are rotationally mounted. The bearings for the roller bodies 62*c* can in particular be needle bearings, spherical bearings or barrel-shaped bearings which offer the lowest possible resistance to the rotation of the roller bodies 62*c*. A receptacle 63*a* for a spring 63 is formed in the center of the pedal 60. The spring 63 serves to move the sliding plate 61 back into its initial position after a movement transverse to the longitudinal axis of the binding. To this end, the spring 63 protrudes through the sliding piece support 61*a* and is supported on studs 61*d* on the sliding piece 61*b*.

Two spring brackets 64 and a separate spring link 65 together form the mechanism by which the brake shoes 66 can be moved into the braking position when the ski binding is released, for example due to a fall. The spring brackets 64 can be connected to the pedal 60 and the spring link 65 can be connected to the pedal 60 and a foot plate 67.

The sliding piece 61*b*, the pedal 60 and the brake shoes 66 can be formed from plastic, while the sliding piece support 61*a*, the spring 63, the rollers 62, the spring brackets 64 and the spring link 65 are preferably manufactured from metal, for example steel.

FIG. 13 again shows an exploded drawing of the heel retainer 1 comprising the spindle plate 34, such as is already known from FIG. 9. Only the most important parts of the heel retainer 1 have been provided with reference signs. Contrary to the heel retainer 1 of FIG. 9, the heel retainer of FIG. 13 comprises a mushroom-shaped ski brake securing means 67 which comprises a thread which can be screwed into a fixture 68 which is formed in part by the spindle plate 34, i.e. the ski brake securing means 67 is fixedly connected to the spindle plate 34. If the spindle plate 34 is shifted in or counter to the skiing direction, the ski brake securing means 67 will therefore be moved by the same distance and in the same direction as the spindle plate 34 and the heel retainer 1 above it.

Alternatively, the ski brake securing means 67 can for example be connected to the base plate or to the ski. The spindle plate 34 can then comprise a cavity in the form of an elongated hole, such that the spindle plate 34 can be moved from the travelling position to the walking position together with the heel retainer 1 or together with the heel retainer 1 and the ski brake 40, without the ski brake securing means 67 being moved relative to the ski.

Figure 13:
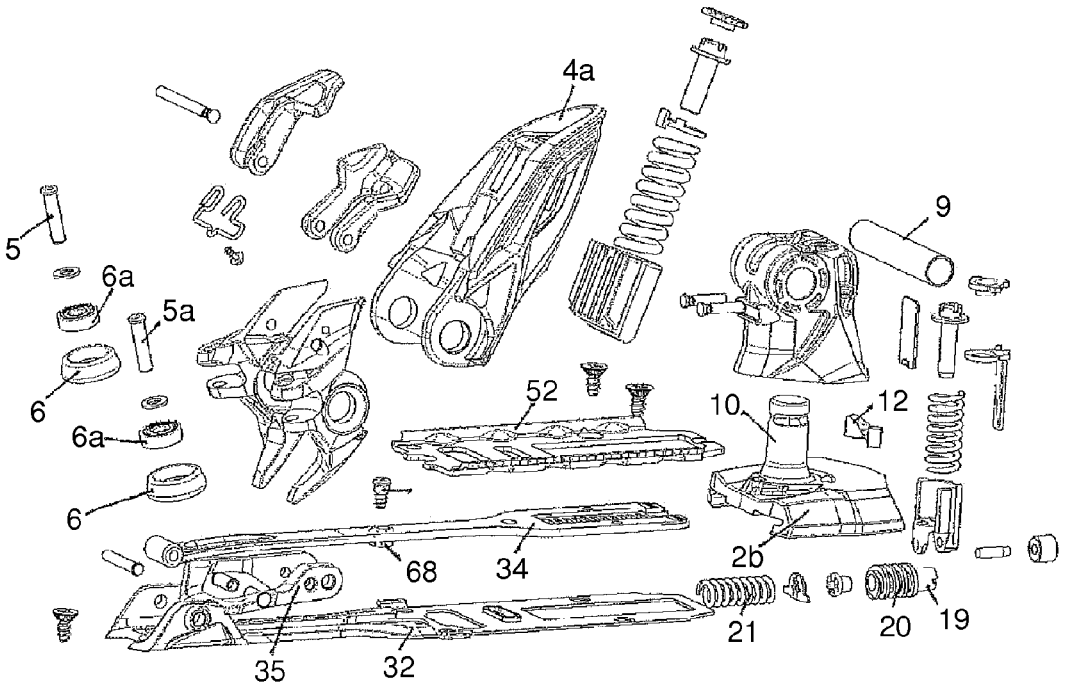
FIG. 13 an exploded drawing of a heel retainer comprising a mushroom-shaped ski brake securing means.

FIG. 13 does not show a ski brake. Reference is made here to FIG. 12. The ski brake comprises two spring brackets 64 which have a front portion to which the brake shoes 66 are fastened. In this region, a distance between the two spring brackets, measured transverse to a longitudinal axis of the ski, is greater than the width of the ski. The brake shoes 66 can thus engage with the snow laterally next to the ski, when the ski brake is released, and slow down the ski. At the other end, the spring brackets 64 comprise a region near to or under the pedal 60 which exhibits a smaller distance and in which the spring brackets 64 extend substantially parallel to each other. With respect to FIG. 13, the ski brake securing means 67 lies—in the downhill position—in the region in which the spring brackets 64 do not extend parallel to each other, such that the ski brake securing means 37 does not prevent a movement of the spring brackets 64 into the braking position when the ski brake is released. In the walking position, the ski brake securing means 67 then lies in the region in which the spring brackets 64 lie parallel to each other, near to or under the pedal 60, wherein the distance between the two spring brackets 64 in this region is equal to or greater than a diameter of the mushroom base and smaller than a diameter of the mushroom head, i.e. the mushroom head lies partially over the spring brackets 64 and thus prevents the ski brake from being able to be released and moved into the braking position.

Figure 14:
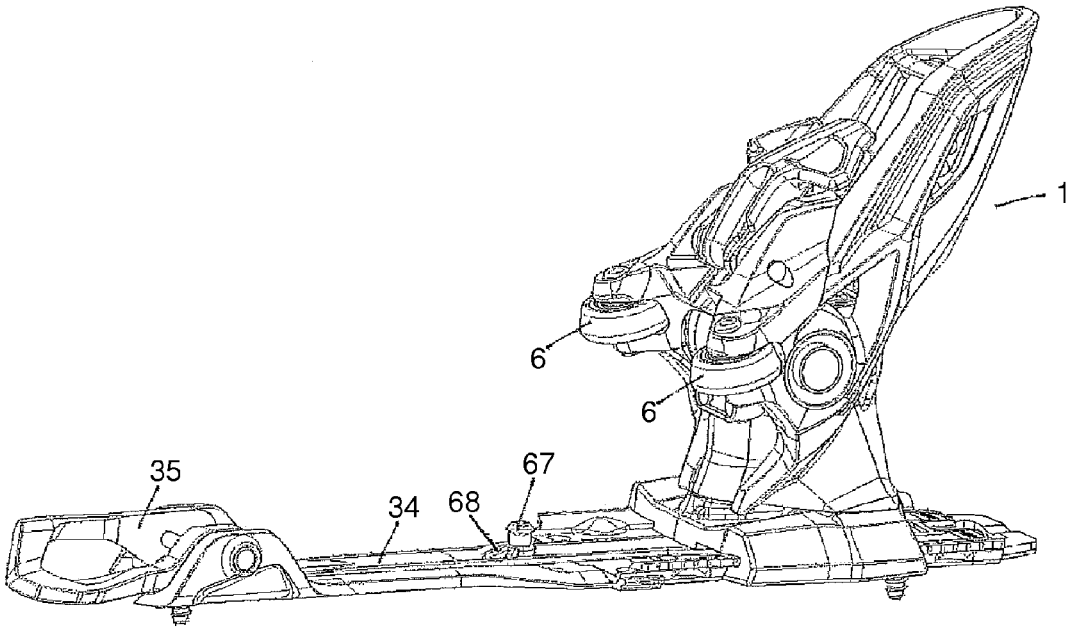
FIG. 14 a perspective view of the heel retainer of FIG. 13.

FIG. 14 shows a perspective lateral view of the heel retainer of FIG. 13. The mushroom-shaped ski brake securing means 67, which is fixedly connected to the spindle plate 34, is shown, wherein the mushroom head can comprise a lower side which faces the surface of the ski and is linear or curved, wherein a slightly curved surface has the advantage that the mushroom head is more easily slid over the spring brackets 64, which are often round, and/or presses them under the mushroom head when the ski brake securing means 67 moves from the travelling position to the walking position. The ski brake securing means 67 can alternatively also be formed to be T-shaped, V-shaped, Y-shaped or the like, in order to prevent the spring brackets 64 in the walking position from pivoting out into the braking position.

The ski brake securing means 67 can be moved into the securing position shown when the ski brake is in the braking position. If the skier then steps into the ski binding, he or she presses the pedal 60 downwards, and the two spring brackets 64 are pressed over the head of the ski brake securing means 67 and briefly pressed apart elastically. As soon as the spring brackets 64 have passed the head at their widest point, they elastically return to their original position, i.e. the distance between the two spring brackets 64 is reduced back to its normal degree, and the spring brackets 64 snap under the head of the ski brake securing means 67, as it were, into the secured position shown in FIG. 15.

The latching element 45 (FIG. 9) can also be embodied elastically, such that here too, the ski brake can be secured when the skier steps into the ski binding, with the ski brake in the braking position.

The head of the ski brake securing means 67 can also be elastically connected to the base, such that the head can be moved slightly in a direction transverse to the longitudinal and transverse direction of the ski when it passes into engagement with the spring brackets 64.

Figure 15:
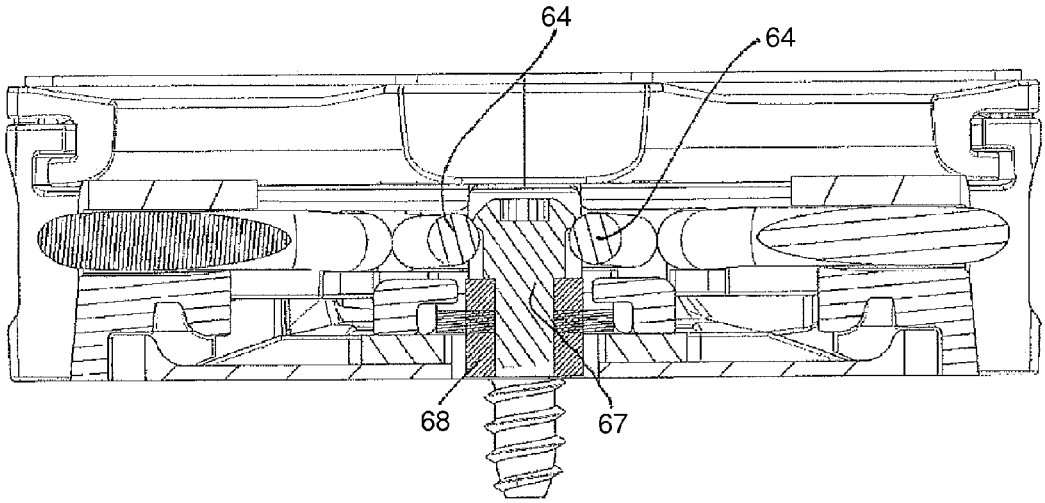
FIG. 15 a sectional view through a ski binding comprising a mushroom-shaped ski brake securing means.

FIG. 15 shows a sectional view through a ski binding, transverse to the skiing direction, at the level of the center of the ski brake securing means 67. Only the ski brake securing means 67, the fixture 68 and the spring brackets 64, which lie within the head of the ski brake securing means 67 and cannot therefore be moved from the secured position shown to the braking position in which the brake shoes engage with the snow, are indicated.

Figure 16:
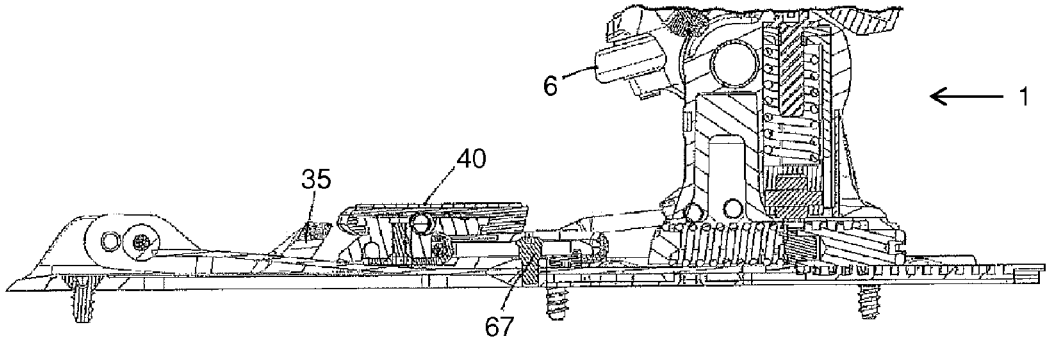
FIG. 16 a sectional view of the heel retainer of FIG. 13 comprising a ski brake, in the walking position.
Figure 17:
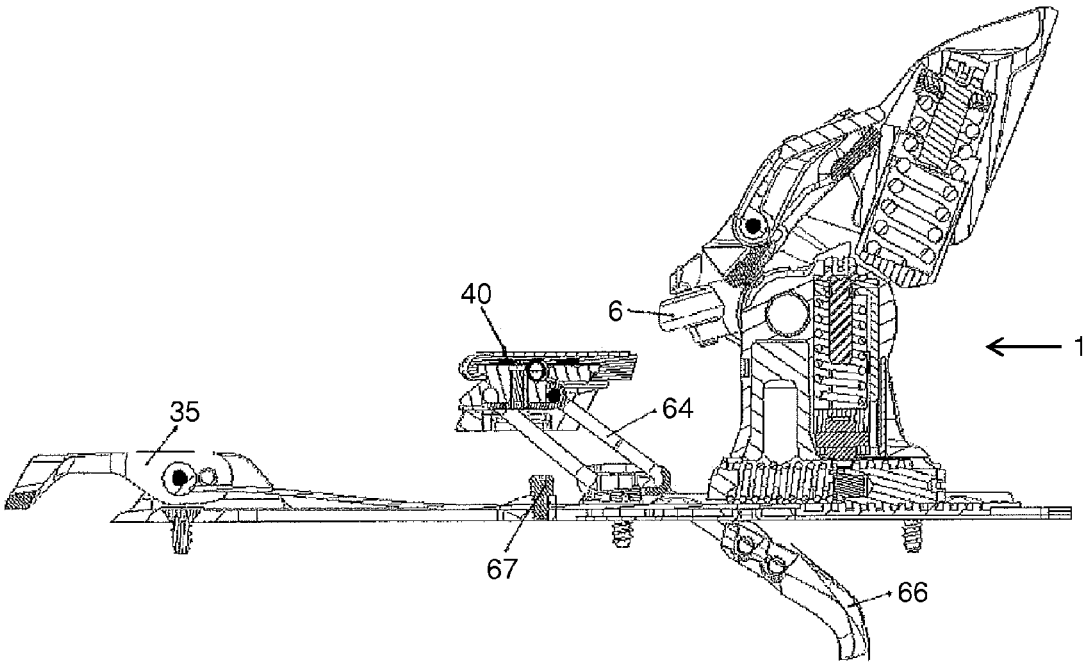
FIG. 17 a sectional view of the heel retainer of FIG. 13 comprising a ski brake, in the travelling position.

FIG. 16 shows a sectional view along the center line of the ski, with the heel retainer 1 in the walking position. FIG. 17 shows the same view, but with the heel retainer now in the travelling position and the ski brake 40 in the braking position.

Figure 18:
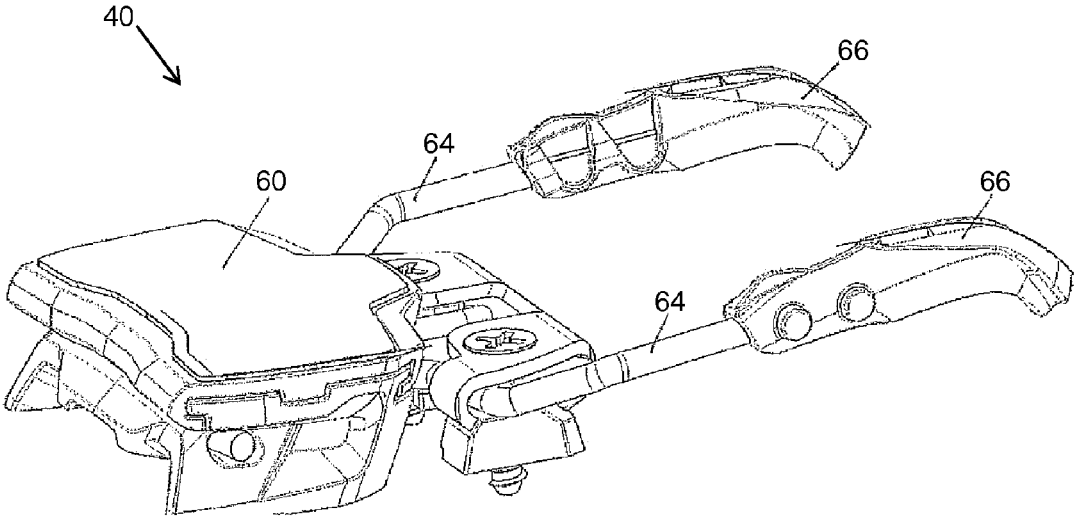
FIG. 18 a perspective view of the ski brake of the heel retainer of FIGS. 16 and 17.

FIG. 18 shows a ski brake 40 comprising the pedal 60, the spring brackets 64 and the brake shoes 66, in the position in which the brake is held in the travelling mode by the weight of the skier or in which the ski brake securing means 67; 45 (not indicated) holds the ski brake 40 in the walking mode or while transporting the ski, wherein the ski brake 40 can be fixedly connected to the base plate or to the ski, such that the heel retainer and/or the ski brake securing means can be moved relative to the ski brake 40 in and counter to the skiing direction. Alternatively, the ski brake 40 can be fixedly connected to the spindle plate and moved together with the heel retainer relative to the ski brake securing means. When setting the position of the heel retainer relative to the toe retainer (boot size), the heel retainer can be adjusted, on its own or together with the ski brake 40, on the spindle plate in or counter to the skiing direction.

LIST OF REFERENCE SIGNS

1 heel retainer
2 base plate
2*a* grooves
3 connecting structure
3*a* connecting structure part
3*b* connecting structure part
4 tensioning device
4*a* tensioning device body
5 sole retainer
5*a* partial sole retainer
5*b* partial sole retainer
6 roller
6*a* rotary bearing
7 climbing aid
8 climbing aid
9 pivoting axle
10 pivoting axle
11 release device
11*a* roller
12 linkage
13 pressing body
13*a* receptacle
14 toothing
15 latching lever
15*a* partial lever
15*b* partial lever
16 pivoting joint
17 spring element
18 engaging recess
19 holding element
20 outer thread
21 spring element
22 spring element, release spring
23 complementary toothing
24 strut
25 extension
25*a* end
26 —
27 —
28 —
29 —
30 —
31 heel retainer
32 fastening device
32*a* mounting
33 guiding portion
33*a* engaging element
33*b* engaging element
34 spindle plate
35 latching lever
36 grip
37 arm
37*a* bore
37*b* bore
38 arm
38*a* bore
38*b* bore
39 bridge
40 ski brake

41 base body
42 brake element
43 brake element
44 opening
45 latching element
46 axial body
47 accommodating region
48 end region
49 connecting region
49*a* grooves
50 —
51 —
52 base plate
52*a* engagement
52*b* engagement
52*c* cavity
60 pedal
61 sliding plate
61*a* sliding piece support
61*b* sliding piece
61*c* sliding piece insert
61*d* stud
62 rollers
62*a* receptacle
62*b* axle
62*c* roller body
63 spring
63*a* receptacle
64 spring bracket
65 spring link
66 brake shoe
67 ski brake securing means
68 fixture

The invention claimed is:

1. A heel retainer for a combined downhill and touring binding for a ski, comprising:

a base plate which can be fastened on an upper side of the ski;

a connecting structure;

a tensioning device for securely holding a ski boot in the heel retainer, comprising a sole retainer;

a shifting mechanism using which the heel retainer can be moved from a travelling position to a walking position and vice versa; and a latching mechanism which latches at least parts of the heel retainer in the travelling position or in the walking position, wherein the latching mechanism comprises a latching lever which can be operated manually or using a ski pole and which latches the heel retainer at least in the travelling position, wherein the parts of the heel retainer for changing from the travelling position to the walking position and vice versa can be linearly shifted on the base plate, wherein the latching lever is connected to the connecting structure via a spindle plate, and wherein the latching lever is connected in a lever pivoting joint to a fastening device which is fixed to the ski, and is connected in a spindle plate pivoting joint to a front end of the spindle plate, wherein the lever pivoting joint and the spindle plate pivoting joint do not coincide.

2. The heel retainer according to claim 1, wherein the fastening device comprises a mounting which forms part of the lever pivoting joint, and a guiding portion which is connected to the base plate.

3. The heel retainer according to claim 1, wherein the lever pivoting point and the spindle plate pivoting point form a toggle lever.

4. The heel retainer according to claim 1, wherein the fastening device forms a guide for the spindle plate to prevent the spindle plate from flexing upwards.

5. A heel retainer for a combined downhill and touring binding for a ski, comprising:

a base plate which can be fastened on an upper side of the ski;

a connecting structure;

a tensioning device for securely holding a ski boot in the heel retainer, comprising a sole retainer;

a shifting mechanism using which the heel retainer can be moved from a travelling position to a walking position and vice versa; and a latching mechanism which latches at least parts of the heel retainer in the travelling position or in the walking position, wherein the latching mechanism comprises a latching lever which can be operated manually or using a ski pole and which latches the heel retainer at least in the travelling position, wherein the parts of the heel retainer for changing from the travelling position to the walking position and vice versa can be linearly shifted on the base plate, and wherein the latching lever is connected to the connecting structure via a spindle plate and a rear end of the spindle plate comprises a connecting region featuring grooves with which an outer thread of a holding element engages.

* * * * *